US005301623A

United States Patent [19]

McMillen

[11] Patent Number: 5,301,623

[45] Date of Patent: Apr. 12, 1994

[54] MULTI HULL VESSEL WITH BENDABLE HULLS

[76] Inventor: Winton P. McMillen, 1552 Miramar, Balboa Point, Calif. 92661

[21] Appl. No.: 689,310

[22] Filed: Apr. 22, 1991

[51] Int. Cl.[5] ..... B63B 1/00

[52] U.S. Cl. ..... 114/61; 114/39.1

[58] Field of Search ..... 114/39.1, 39.2, 56, 114/61, 85, 144 R, 271, 288, 264, 266, 267, 343, 355, 357; D12/303, 304, 300

[56] References Cited

U.S. PATENT DOCUMENTS

| | | | |
|---|---|---|---|
| 1,288,689 | 12/1918 | Samphere | 114/61 |
| 1,364,961 | 1/1921 | Thompson | 114/61 |
| 3,841,251 | 10/1974 | Larson | 114/39 |
| 3,883,909 | 5/1975 | Fisher | 114/61 |
| 3,937,171 | 2/1976 | Seaborn | 114/61 |
| 3,961,590 | 6/1976 | Kefalos | 114/61 |
| 3,970,025 | 7/1976 | Sovia et al. | 114/61 |
| 3,986,219 | 10/1976 | Michowski | 114/61 |
| 4,213,412 | 7/1980 | Jamieson | 114/61 |
| 4,452,166 | 6/1984 | Daniel | 114/61 |
| 4,512,275 | 4/1985 | Drumm | 114/61 |
| 4,757,777 | 7/1988 | Rosenberger | 114/39 |
| 4,919,632 | 4/1990 | Smith | 114/61 |
| 4,968,274 | 11/1990 | Gregory | 114/61 |
| 4,996,935 | 3/1991 | Takeuchi | 114/61 |

*Primary Examiner*—Robert J. Oberleitner
*Assistant Examiner*—Clifford T. Bartz
*Attorney, Agent, or Firm*—Poms, Smith, Lande & Rose

[57] ABSTRACT

A catamaran sailing vessel has both of its hulls articulated to provide substantially equal length forward and aft hull sections that are pivotally connected to one another about axes parallel to the yaw axis. A rigid deck structure spans the two hulls and is pivoted about axes parallel to the yaw axis to the aft sections of each articulated hull. The deck structure is pivotally and slidably connected to the forward sections of the two hulls to enable rotation of these relative to the deck structure about axes parallel to the yaw axis and to allow the forward hull sections to slide relative to the deck structure about axes parallel to the roll axis of a vessel. A cross member is transversely shiftably mounted on the deck structure and is pivoted to the articulated hull sections on their pivot axes so that when the cross member is driven toward one side or the other the two hulls will bend in unison. A longitudinal strut is fixed to and extends forwardly of the deck structure for mounting a forestay for the mast that is stepped onto a forward portion of the deck structure.

49 Claims, 6 Drawing Sheets

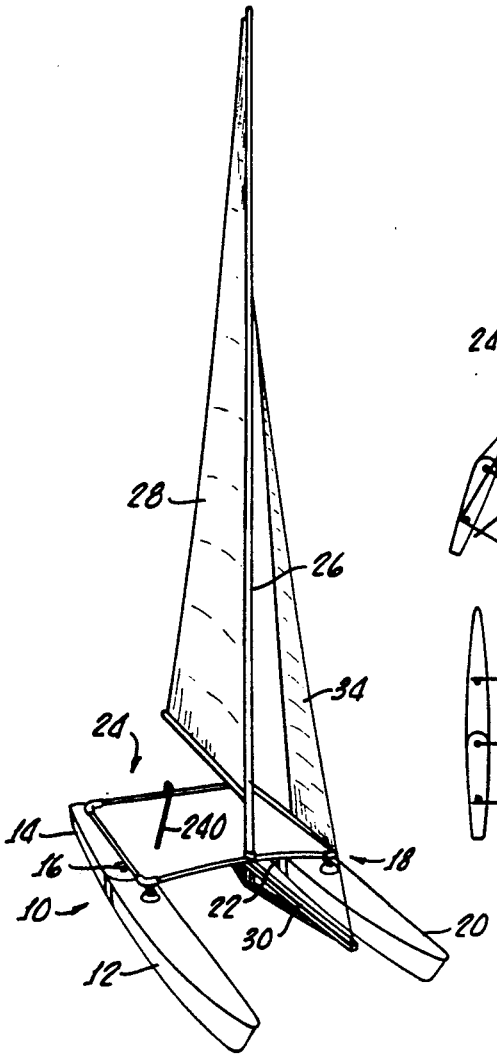
FIG. 1.
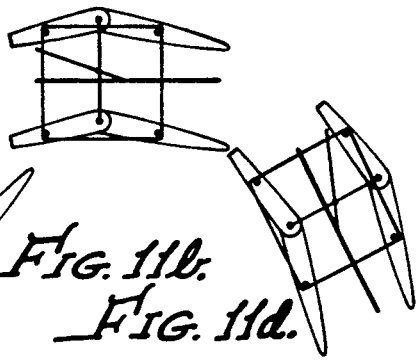
FIG. 11c.
FIG. 11b.
FIG. 11d.
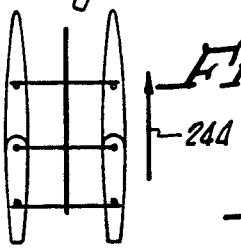
FIG. 11a.
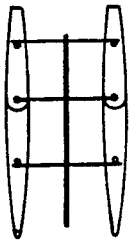
FIG. 11e.
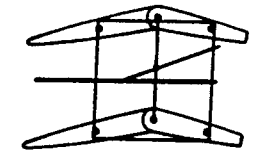
FIG. 12c.
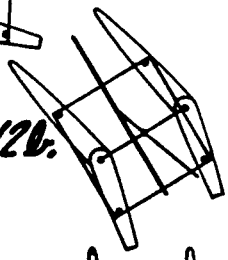
FIG. 12b.
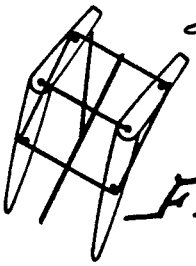
FIG. 12d.
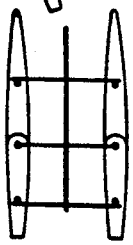
FIG. 12a.
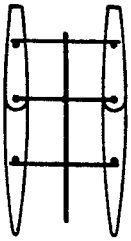
FIG. 12e.

FIG. 5.
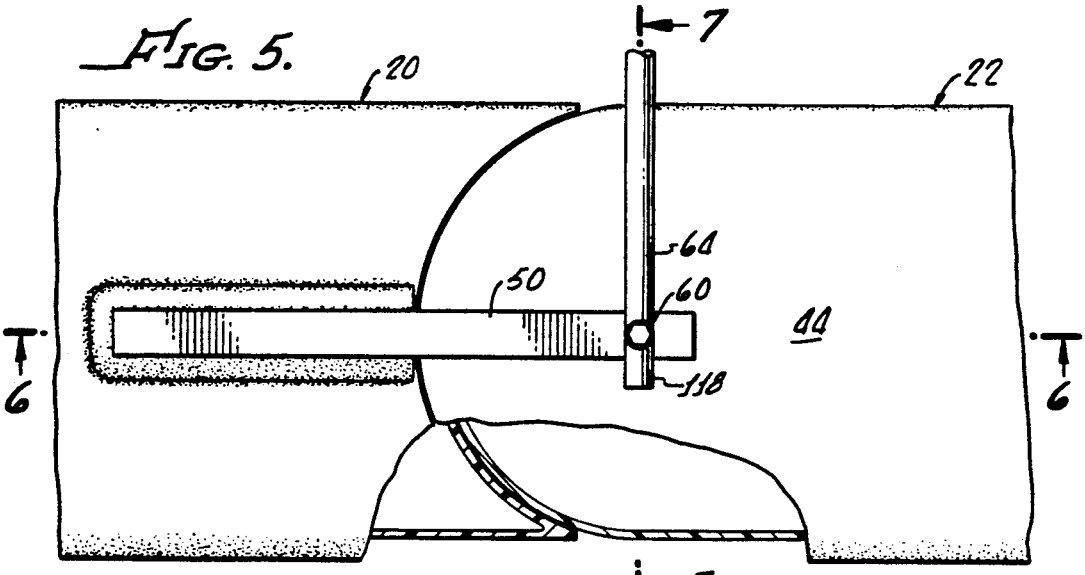
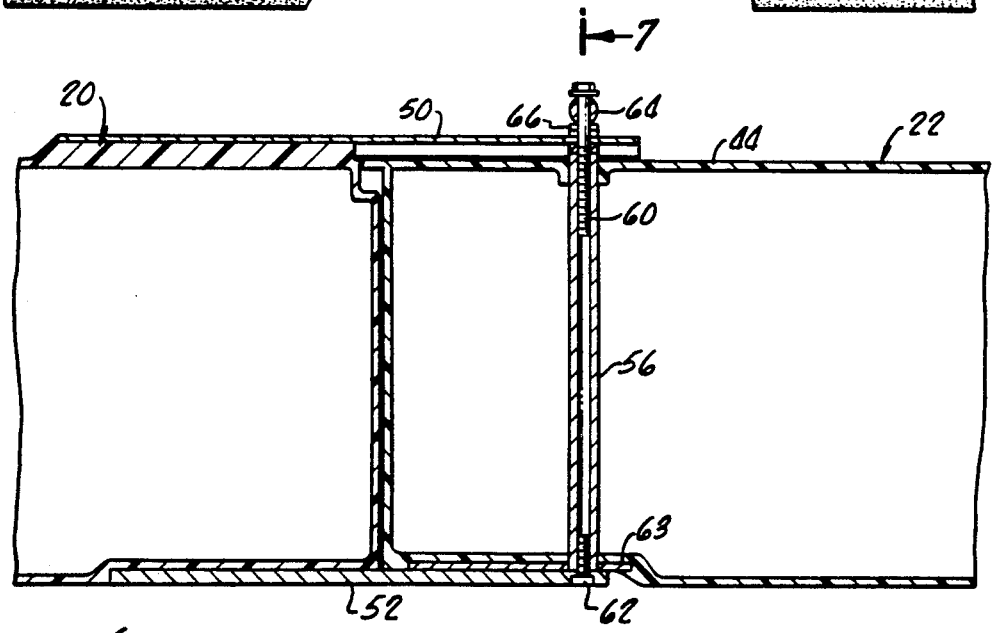
FIG. 6.
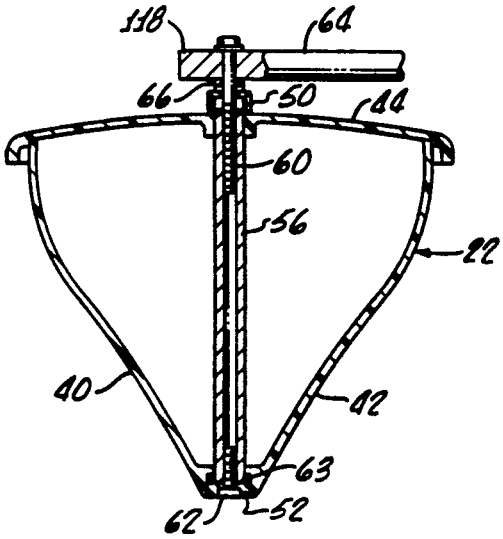
FIG. 7.

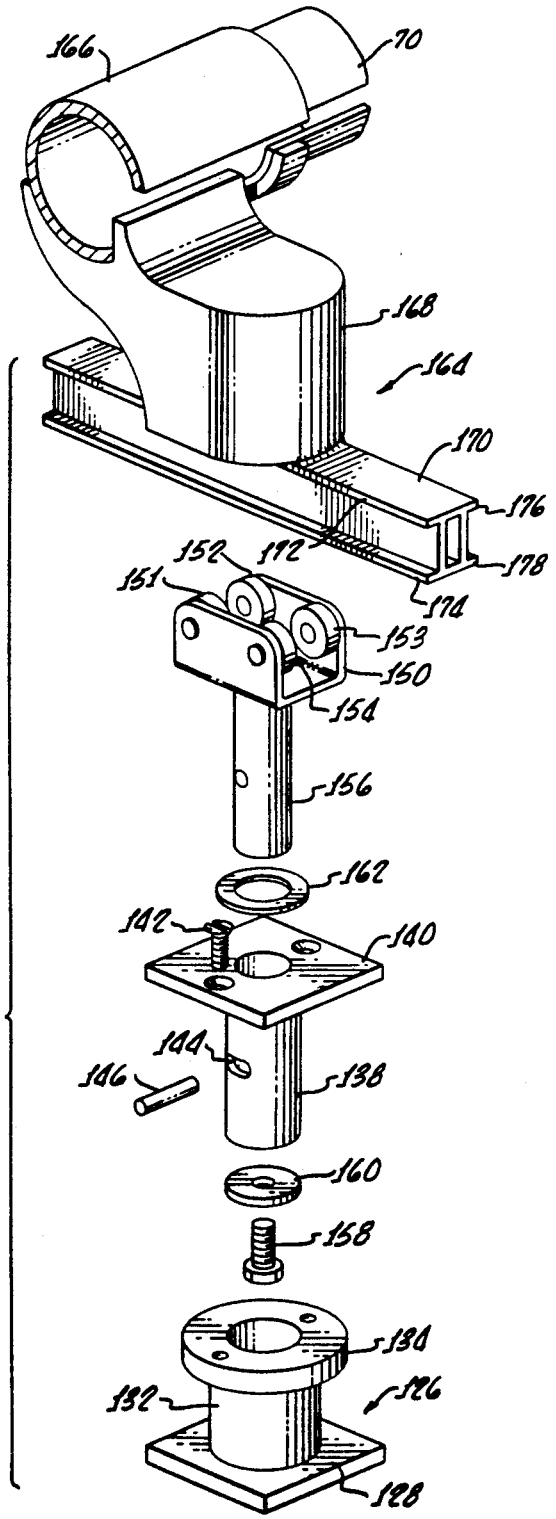
FIG. 9.
FIG. 8.
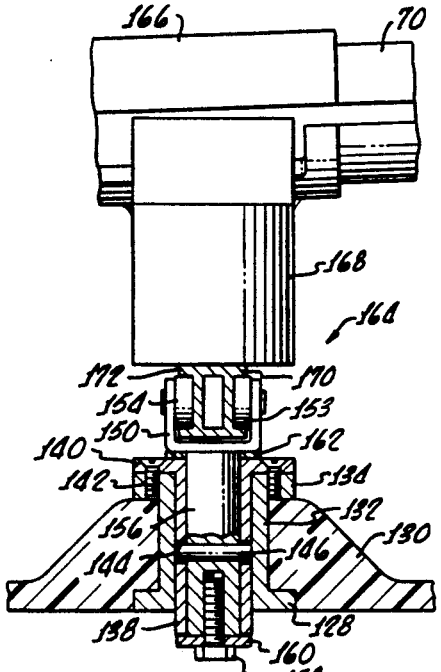
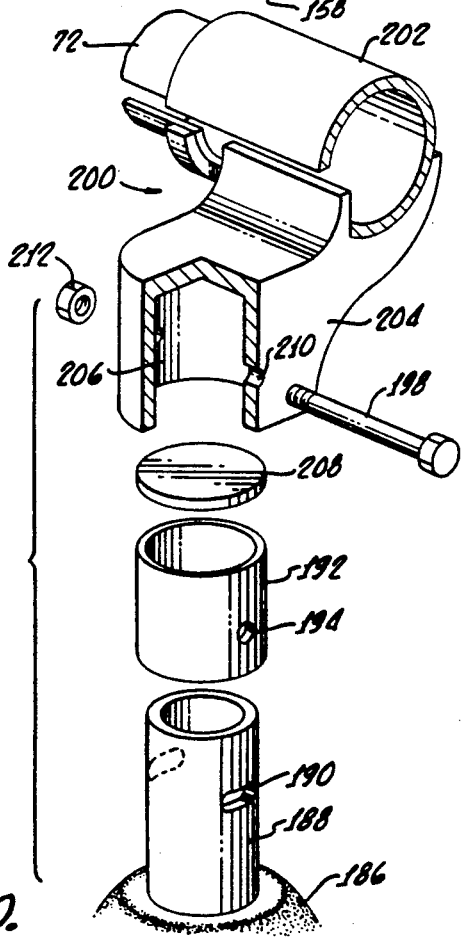
FIG. 10.

FIG. 13.
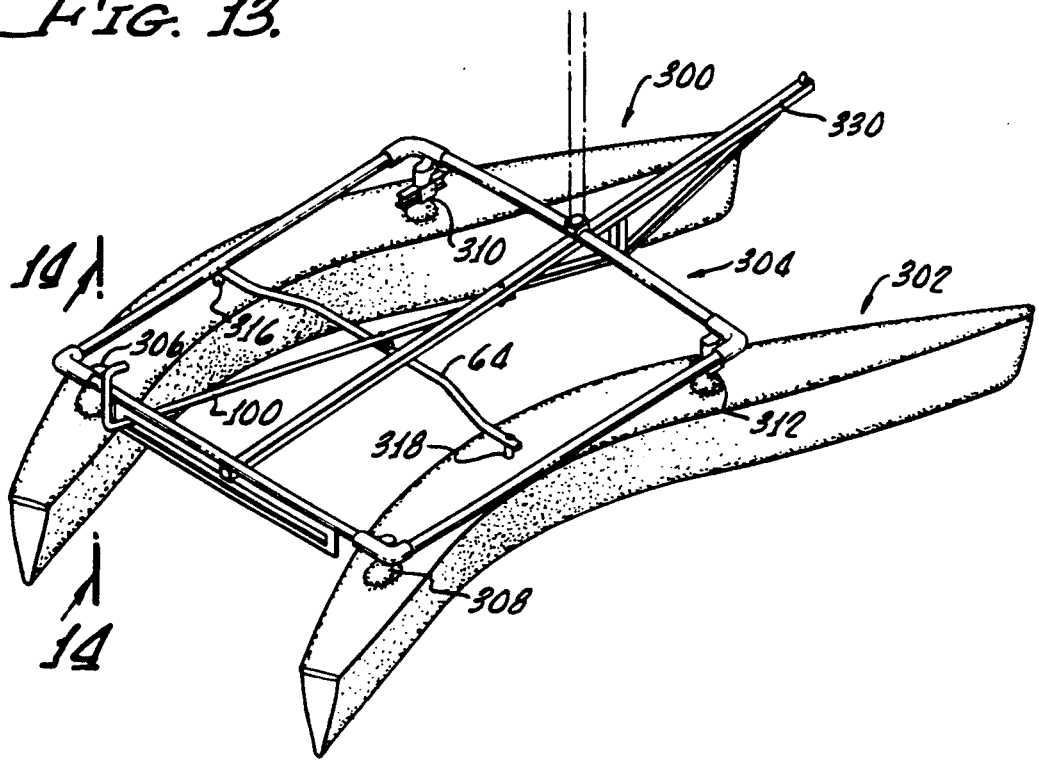
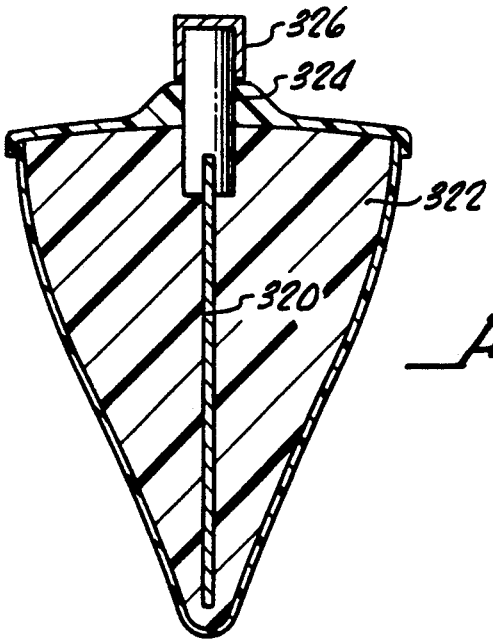
FIG. 14.

MULTI HULL VESSEL WITH BENDABLE HULLS

BACKGROUND OF THE INVENTION

The present invention relates to multi hulled water borne craft and more particularly concerns a catamaran vessel having articulated or bendable hulls for improved steering.

Multi hulled vessels, such as sailing catamarans, have significant advantages over mono hulled sailing vessels in affording greater speed, greater lateral stability, shallow draft and ability to carry larger amounts of sail. However, a major disadvantage of the multi hulled vessel is its lack of maneuverability. When a mono hull vessel is turned, the vessel may be considered to effectively pivot about a substantially vertical axis extending through and near a midpoint of the hull. When a multi hull vessel is turned, however, one may consider that one of the hulls can effectively pivot about a vertical axis, but the other must be laterally dragged through the water to effect the turning maneuver, and thus provides very large resistance to the turn. Whereas a mono hull sailing vessel may be able to tack at relatively low forward speed, the catamaran is notorious for requiring significantly higher forward speed to enable the vessel to come about. It is not infrequent, in attempting to tack at insufficient forward speeds, that the catamaran will lose its way and become dead in the water because of this poor maneuvering ability.

Another serious disadvantage of dual hull vessels derives in part from attempts to improve maneuverability. Such attempts include use of a somewhat "banana" shaped longitudinal hull bottom, wherein both forward and aft ends of both hull bottoms are curved upwardly to a significant extent, thereby to provide less lateral resistance during turning maneuvers. This improvement in maneuverability is attained only at the expense of significantly decreased resistance to lateral drift.

Accordingly, it is an object of the present invention to provide a multi hulled water draft that avoids or minimizes above mentioned problems.

SUMMARY OF THE INVENTION

In carrying out principles of the present invention in accordance with a preferred embodiment thereof a sailing vessel includes a pair of mutually laterally spaced hulls, each of which is articulated about an axis that is nominally substantially vertical. In one configuration, instead of a pivotal connection, each hull has a flexible intermediate portion. A deck structure, movably secured to both the hulls at points both fore and aft of points amidships of the hulls, carries control means operable to bend each hull in a generally horizontal plane. According to a feature of the invention, the deck is a rigid structure that is pivoted to the forward or aft hull section on each side of the craft and is pivotally and slidably connected to the others of the two hull sections. A cross member is transversely slidably movable on the deck and connected to both of the hulls at points amidships to cause the two hulls to bend in unison.

BRIEF DESCRIPTION OF THE DRAWINGS

FIG. 1 is a pictorial illustration of a sailing catamaran embodying principles of the present invention;

FIG. 5 is a fragmentary plan view of the articulation of a pair of hull sections with parts broken away;

FIGS. 6 and 7 are sections taken on lines 6—6 and 7—7 of FIG. 5;

FIG. 8 is a fragmentary side elevational view with parts in section showing a pivotal and slidable connection between the deck and one of the hull sections;

FIG. 9 is an exploded pictorial view of the pivotal and slidable connection of FIG. 8;

FIG. 10 is an exploded pictorial view of a pivotal connection between the deck structure and one of the hull sections;

FIG. 11 schematically illustrates several positions of the vessel making a turn to starboard;

FIG. 12 illustrates several positions of the vessel in making a turn toward port;

FIG. 13 shows a vessel with modified bendable hulls; and

FIG. 14 is a section taken on lines 14—14 of one of the hulls of the vessel of FIG. 13.

DETAILED DESCRIPTION OF THE INVENTION

Figure 2:
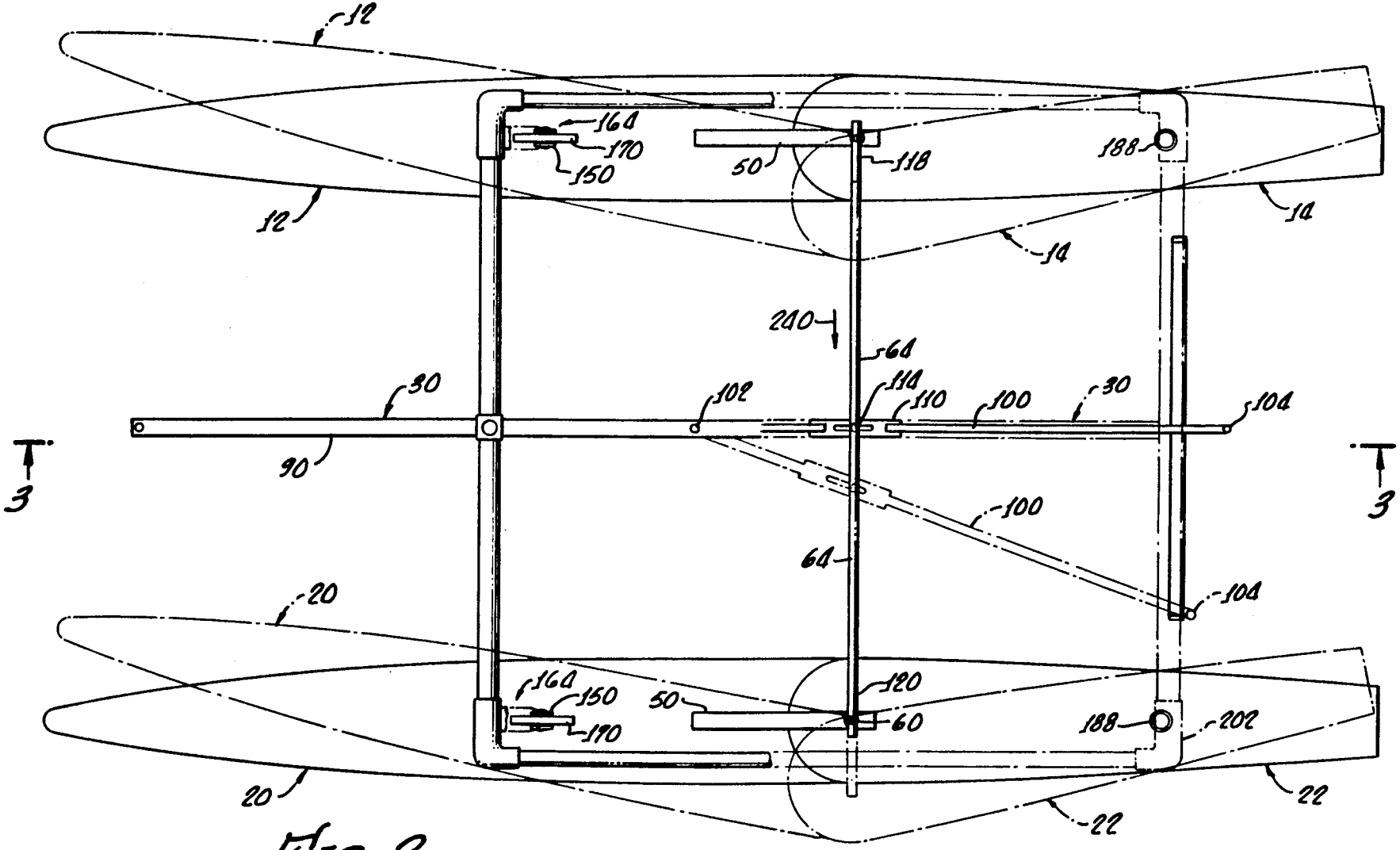
FIG. 2 is a horizontal view of the articulated hull and deck structure of the vessel of FIG. 1 showing hull bending in phantom lines.

As shown in FIG. 1, a dual hulled sailing vessel embodying principles of the present invention includes a starboard hull 10 having fore and aft hull sections 12,14 pivoted to one another about a substantially vertical axis 16, parallel to the yaw axis of the vessel. The vessel has a port hull 18, having a forward hull section 20 and an aft hull section 22 similarly pivoted to one another about a vertical axis parallel to the yaw axis of a vessel. A deck structure 24, having a least a rigid perimetral frame, mounts a mast 26 carrying a sail 28. A longitudinal strut 30 secured to and extending forwardly of the deck structure 24 has an end positioned between forward ends of the hull sections 12,20 for mounting a mast head stay 34.

Figure 3:
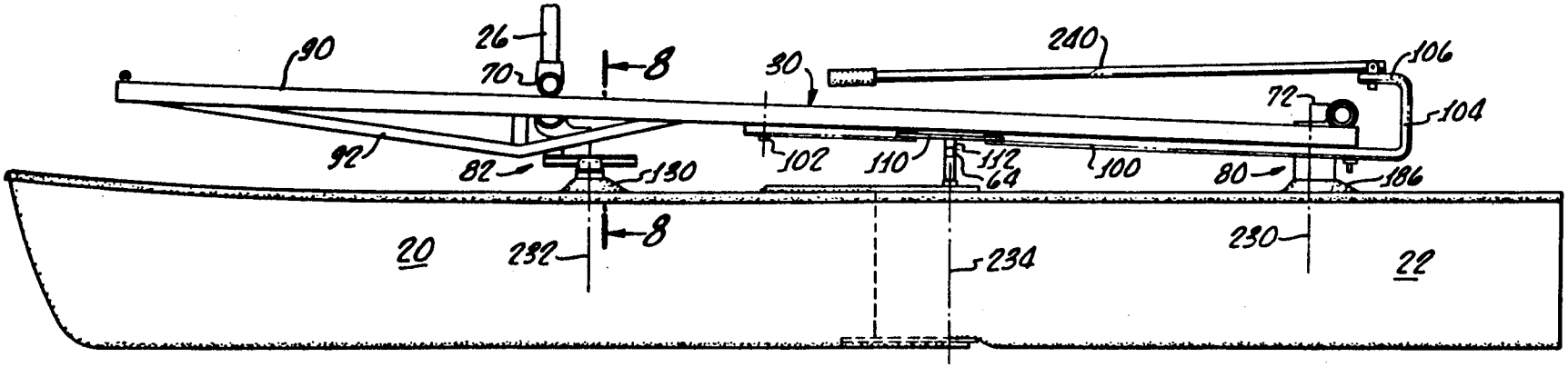
FIG. 3 is a longitudinal side view of one hull and deck structure.

The articulated hull structure is illustrated in FIGS. 2 and 3, with details of the articulation joint shown in FIGS. 5, 6 and 7. The two hull structures are identical to one another, and only one need be described. Each hull section, as best seen in FIG. 7, has a somewhat triangular transverse cross section, symmetrical about a vertical longitudinal plane, and includes side walls 40,42 covered by a top wall 44, which is sealed to the side walls to form a watertight compartment running the full length of the hull section. The aft end of the forward hull section 22 ends in a rearwardly concave aft wall 46 (FIG. 5), having a generally right circular cylindrical configuration to mate with a right circular cylindrical forward wall 48 of the forward end of the aft section 22. Fixedly secured to the top and bottom of the aft end of forward section 20 and extending rearwardly past the aft end of the forward hull section are upper and lower pivot arms 50,52 (FIG. 6). The forward end of aft hull section 22 is provided with a hull reinforcing pivot sleeve 56 extending from top to bottom of the hull section and having its ends fixedly secured in the top and bottom walls of the hull section, as can be seen in FIGS. 6 and 7.

Upper and lower pivot arms 50,52 are apertured to receive a common pivot shaft 58, extending through sleeve 56, and having an upper end 60 which extends above the upper pivot arm 50 for pivotal connection to a cross member 64 (FIG. 7) that will be described more particularly below. A plurality of washers 66 are interposed between the cross member 64 and the upper pivot arm 50. The lower end of shaft 58 is held in place by a nut 62 and washer 63. The described configuration enables the two hull sections to pivot about the axis of shaft 58 between positions, such as illustrated in solid and dotted lines in FIG. 2, thereby providing an articulated hull on each side of the vessel. No more than 30° of pivotal motion is needed.

Figure 4:
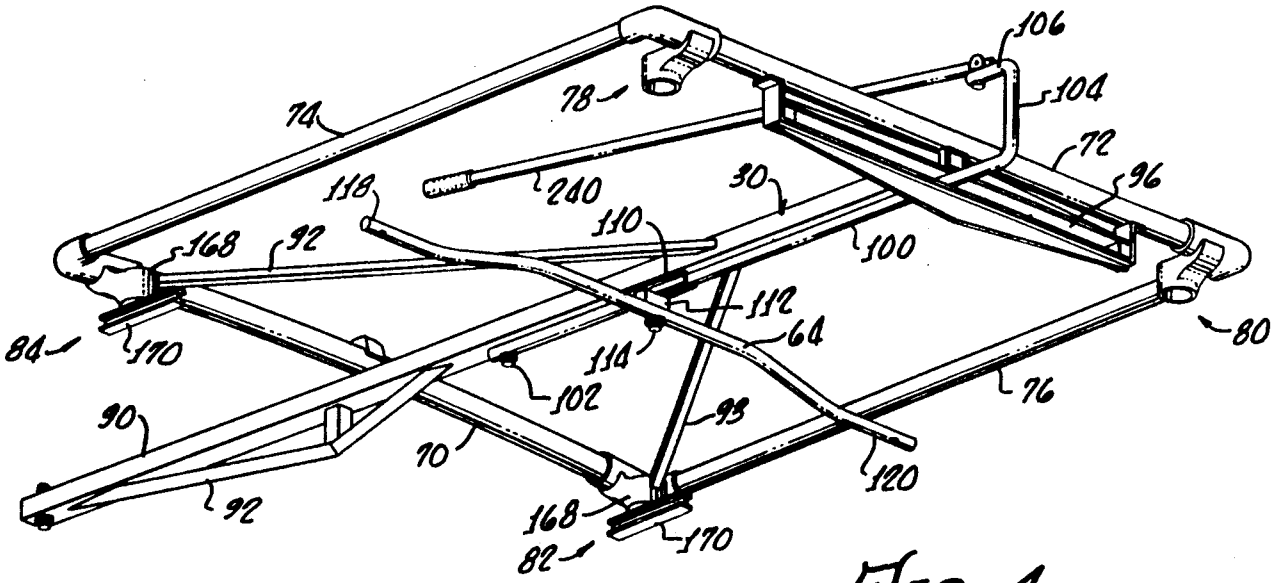
FIG. 4 is a pictorial illustration of the deck structure.

A rigid deck structure shown in the pictorial view of FIG. 4 includes a rigid, tubular perimetral frame formed of rigidly interconnected forward and aft bars 70,72 and side bars 74,76, provided with four connecting points generally indicated at 78,80,82 and 84. The rigid deck structure is pivotally connected to the aft hull sections at connecting points 78,80 so that the hull sections can pivot at these points relative to the deck structure about axes parallel to the yaw axis of the vessel. The deck structure is also pivoted to the forward sections 12 and 20 at connecting points 82,84. Connections at 82,84 also provide for a limited amount of slidable motion of the forward hull sections relative to the deck structure so that the forward hull sections can pivot relative to the deck structure about axes parallel to the yaw axis of the vessel and also can slide relative to the deck structure along axes parallel to the vessel roll axis.

Fixedly mounted to the deck structure, as by being welded or otherwise rigidly attached to the forward and rear deck bars 70,72, is the longitudinal strut 30, having a forward portion 90 which extends well forward (the strut extends underneath the deck structure) of the forward bar 70 of the deck structure. A strut reinforcing truss arrangement 92 is provided to strengthen the forwardly cantilevered end 90 of the longitudinal strut, which is also stiffened by angled braces 92,93 extending between and fixedly connected to the deck structure at forward corners thereof and to opposite sides of an intermediate point of the strut 30.

Fixed to the underside of rear deck bar 72 and extending transversely for a major portion of its length is a tiller guide 94 having a transversely extending guide slot 96 that slidably and guidably receives a tiller or control rod 100 that extends in a central position longitudinally along and below the strut 30. Control rod 100 is pivoted, at its forward end, to strut 30 on a pivot pin 102 to allow the rod to pivot about an axis parallel to the vessel yaw axis. The aft end of control rod 100 extends through and rearwardly of the guide slot 96 and then bends upwardly and forwardly, as indicated at 104, to provide a forwardly extending handle 106 that allow the control rod to receive a tiller (FIG. 3) that allows the rod to be manipulated and moved from side to side within the guide slot 96.

A longitudinally extending bracket 110 fixed to the underside of control rod 100 mounts a slider 112 for limited fore and aft slidable motion relative to the control rod 100. A pivot pin 114 is fixed to and depends from slider 112 and is journalled in an aperture formed at a midpoint of cross member 64 which is thereby pivotally connected to the control rod with a small degree of slidable motion permitted in the direction of the length of the control rod.

The ends 118,120 of the control rod, as previously mentioned in connection with the drawings of FIGS. 5, 6 and 7, are respectively pivotally connected to the pivot shafts 58 that pivotally interconnect the fore and aft starboard and the fore and aft port hull sections.

Although the embodiment illustrated in the drawings shows the two pivotal connections between the deck structure and the hull sections to be located at the aft hull sections, whereas the combined pivotal and sliding connections are located at the forward hull sections, it will be readily appreciated that the pivotal and sliding connections may be arranged to interconnect the deck structure with the aft hull sections and the pure pivotal connections may be located at the forward hull sections, merely reversing the position of these forward and aft connections. Details of pivotal and sliding connection between deck structure and hull sections are illustrated in FIGS. 8 and 9, which show a hull fitting 126 including an integral lower flange 128 that is fixed to and embedded in a boss 130 (FIG. 3 and FIG. 8) that is formed as a fixed part of the upper wall of the hull section.

Fitting 126 includes an upstanding sleeve 132 and an upper flange 134 which lies at the top of boss 130, with sleeve 132 extending through the boss, thus securely and rigidly attaching the fitting to the hull. A journal sleeve 138 is pivotally received within the sleeve 132 of fitting 134 and includes an upper flange 140 that is bolted to flange 134 by means of screws or bolts 142. Sleeve 138 is formed with a pair of diametrically opposed, circumferentially extending short slots 144 which receive opposite ends of a locking pin 146 that extends through the sleeve 138. A channel 150 mounts four rollers 151, 152, 153 and 154, journalled on substantially horizontal axes within the two inner sides of the channel, to which is affixed a downwardly extending pivot shaft 156 that is received rotatably within sleeve 138 and held in position by pin 146, which extends through an aperture in shaft 156 and through slots 144. Shaft 156 is also held in place by means of a longitudinal screw 158 which threadedly extends into the bottom of the shaft and cooperates with a washer 160 to hold shaft 156 in its longitudinal position within sleeve 138. A washer 162 is interposed between the bottom of channel 150 and the upper flange 140 of sleeve 138.

Forward bar 70 of the deck structure has rigidly secured thereto a fitting 164, having a sleeve portion 166 encircling and fixed to the bar 70. A depending body portion 168 fixedly carries a short longitudinally extending rail 170, having transversely projecting and longitudinally extending upper and lower side rails 172,174 on one side and 176,178 on the other. Rollers 151 through 154 are captured between the flanges 172, 174, 176 and 178 to permit a limited amount of relative slidable motion of the deck structure 70 and rail 170 relative to the pivot shaft 156 and its mounting sleeves 138,126. Pin 146 extending through the slots of sleeve 138 and through a close fitting aperture in shaft 156 limits rotation of the hull relative to the deck structure to a relatively small amount, such as 30°, for example. The pivotable and slidable connection to the other forward hull section is identical to that described and illustrated in FIGS. 8 and 9.

FIG. 10 illustrates one of the pure pivot connections which interconnect the rear hull sections and rear portions of the deck structure. The two pivot connections between the deck structure and the two aft hull sections are identical. A boss 186 rigidly connected to the top wall of the aft hull section fixedly carries an upstanding hull sleeve 188 having short oppositely disposed, circumferential slots 190 formed in the walls thereof. A bearing sleeve 192 receives sleeve 188 and includes a pair of diametrically opposed apertures 194, which receive a locking bolt 198. Aft deck structure bar 72 fixedly carries a fitting 200, having a sleeve portion 202 that is fixedly secured to the bar 72, and a fixed body portion 204 having a downwardly extending bore 206 that is closed at its upper end. Bore 206 receives the bearing sleeve 192 with an end bearing disc 208 interposed between the closed end of bore 206 and the upper end of sleeve 192. After assembly of body 204, and sleeves 192, 188, locking bolt 198 is inserted through apertures 210 in the walls of fitting body 206 to extend through the apertures 194 of bearing sleeve 192 and through the diametrically opposed circumferentially extending short slots 190 of fixed pivot sleeve 188. Bolt 198 is held in place by a nut 212. Thus the deck structure is pivoted to the aft hull section for limited pivotal motion (about 30°, for example) about an axis parallel to the yaw axis of the vessel.

FIG. 3 illustrates the relation of the deck structure to one of the articulated hulls. It will be understood that the other side of the deck structure is related to and connected to the other of the articulated hulls in identical fashion. As can be seen in FIG. 3, the rear portion of the rigid deck structure is pivoted to aft hull section 22 on an axis 230, which is the axis of the pivotal connection illustrated in FIG. 10. The forward portion of the deck structure is pivotally connected to forward hull section 20 about an axis 232 which is the axis of the pivotal connection illustrated in FIGS. 8 and 9.

The forward and aft hull sections are directly pivotally connected to one another for limited pivotal motion about an axis 234 which is the axis of pivot shaft 58 shown in FIGS. 6 and 7. Axes 230,232 and 234, together with their counterparts on the other hull are all parallel to one another and to the yaw axis of the vessel. A tiller 240 is pivoted to the forwardly extending arm 106 of control rod 100 and extends forwardly therefrom to allow manual operation of the control rod to shift the control rod from side to side and thereby shift the cross member 64 from side.

As can be seen in FIG. 2, the connecting points between the rigid deck structure and the four hull sections are positioned in a quadrilateral pattern, or more specifically in a rectangular pattern, being located adjacent the corners of the rectangular deck frame, with the respective hull sections being pivotally connected to the deck frame substantially at each corner. Each forward and each aft hull section is pivotally moved about its pivotal connection with respect to the deck structure by the cross member 64, which is transversely reciprocal by operation of the tiller 240 and control rod 100.

Thus the articulated hulls may be moved in unison from the solid line position of FIG. 2 to the phantom line position by moving the control or cross member 64 to the port side of the vessel, as indicated by arrow 240, thereby pivoting both of the forward hull sections in a clockwise direction (as viewed in FIG. 2) around their pivotal connections to the deck structure and concomitantly pivoting the aft sections in a counterclockwise direction about their pivotal connection to the aft portion of the deck structure. As each articulated hull bends, the distance between the two pivot points (between the deck structure and the aft hull section and the deck structure and forward hull section) remains fixed, as controlled by the deck structure, but the position of one of these pivot points with respect to the hull section must change to accommodate this bending. Thus, either the pivot connection at the aft section or at the forward section must move. As illustrated in the disclosed embodiment, this motion is handled by the use of the slidable connection illustrated in detail in FIGS. 8 and 9 that is combined with the pivotal connection between the deck structure and the port hull sections. In bending the hulls to the bent position illustrated in FIG. 2, the cross member 64 is driven to port by means of the control rod 100, which has its rearward portion arm 104 moved to the port side of the vessel within the guiding slot 96. The hulls are bent in the opposite direction by shifting control rod 100 to starboard.

With the vessel moving in the direction indicated by arrow 244 in FIG. 11, and with the vessel positioned as shown in FIG. 11*a*, when the tiller moves to port the hulls bend in unison, as shown in FIG. 11*b*, to cause the vessel to change direction for a turn to starboard to go through successive positions illustrated in FIGS. 11*c*, 11*d*, and 11*e*, maintaining their parallel relation at all times.

As the hulls are bent by moving the tiller to one side or the other, both sections of both hulls act as rudders. No other rudder, other than the hulls themselves, is needed or employed. The forward direction of the vessel causes a force to be exerted, as indicated by arrow 246, upon the forward hull sections, thus providing a turning force on the hulls. The articulation of the aft sections causes a decrease in drag as the vessel turns. Moreover, the counterclockwise bending of the aft section (about the articulation axis of the fore and aft hull sections) causes this section too to receive a force caused by forward motion of the vessel that aids in the same turning action. Thus the articulation of the sections of both hulls causes all four sections to react to the forward motion of the vessel and exert a turning force on the vessel.

In a like manner, as illustrated in FIGS. 12*a*, 12*b*, 12*c*, 12*d*, and 12*e*, with the vehicle going in the direction illustrated by arrow 250, moving control rod 100 to starboard causes both hulls to be articulated in the opposite direction, effecting a counterclockwise rotation of the forward hull section about their articulation axes and effecting a clockwise rotation of the after hull sections about their articulation axes. Accordingly, all four hull sections react to the forces caused by the forward motion of the vessel through the water to move successively through the positions illustrated in FIGS. 12*a*, 12*b*, 12*c*, 12*d* and 12*e*.

In an embodiment of this vessel which has been built and tested, it is found that the vessel can turn in a distance not much greater than its own length, in a wind of as little as one or two knots. In addition to the greatly increased maneuverability afforded by the bendable hulls, there are many other advantages of the described configuration. Because the hulls act as rudders, no separate or independent rudder or steering arrangements are required. Thus, rudder drag is reduced and rudder structures eliminated. Importantly, the configuration of a longitudinal section of each hull need not be compromised in order to improve maneuverability. As previously mentioned, it is common in a multi hulled vessel to form the longitudinal curve of the hull bottom in a convex or banana shape with both bow and stern portions of the hull curved upwardly so that less of the hull is below the water line at forward and aft portions. For such deference to improved maneuverability the designer pays the significant price of decreased resistance to lateral drift, since the hull shape is such as to decrease the amount of lateral surface area of the hull below the water line. In the present invention, as can be seen in the elevational view of FIG. 3, no such decrease of hull area beneath the water line is necessary. To the contrary, the hull, for its entire length, including bow and stern portions, may have the same height, and therefore the same depth of hull below the water line, because the steerability of the craft afforded by the articulation of the hulls is so much improved. With this increased area of bow and stern sections of the hull below the water line, resistance of the craft to lateral drift is greatly increased, and thus there is little or no need for a center board to help resist the lateral forces exerted by wind on the sails.

In other attempts to improve resistance to lateral drift of the shallow draft, multi hulled vessel of the prior art, cross sectional hull shape has been asymmetrical, with one side curved (as viewed in transverse cross section) and another side of the same hull vertically straight to afford increased resistance to lateral drift. Further, the bottom of the hull is often rounded somewhat to help in turning, and a center board or small keel has been employed in the prior art. In the present invention, because of the increased resistance to lateral drift and the superior turning ability, hull cross section may be symmetrical, as can be seen in FIG. 7, and, moreover, no rounded bottom need be employed. In fact, the cross sectional shape of the hull can be designed for optimum hydrodynamics and may include slightly outwardly concave sections at the bottom portions of the hull, as can be seen in FIG. 7. The slightly concave transverse cross sectional hull provides increased resistance to drift and allows the hulls to float deeper in the water.

Not only do the deeper hull sections at the bow and stern give improved resistance to lateral drift, but they provide improved turning power, since these elements are acting as the rudders of the vessel.

Utilizing hulls that have a symmetrical transverse section enables the gap between the aft end of the forward hull section and the forward end of the aft end section to be decreased.

FIG. 5 illustrates one manner in which the adjacent ends of forward and aft sections of each hull may be interfitted for relative pivotal motion about the axis 234 of pivot shaft 58. It will be readily understood that this configuration is exemplary of but one of many configurations which may be employed to afford pivotal interconnection of the adjacent hull section ends. The ends may be further spaced and suitable farings (not shown) may be applied along the sides of the hull to decrease drag and improve hydrodynamics of the articulated portion of the two hulls.

The relative lengths of the fore and aft hull sections may be varied as deemed necessary or desirable. Although the drawings illustrate the forward hull sections to be longer than the aft hull sections, it will be readily appreciated that the relative lengths may differ from the configurations illustrated. The position of the pivotal connection between the deck and the fore and aft hull sections also may be varied as deemed necessary or desirable. Positioning of these pivot points will affect the helm of the vessel. Thus, a weather helm can be provided in such a vessel by appropriate location of the mast so as to position the center of effort such that the vessel will normally tend to turn into the wind if not controlled by the rudder. The helm of the vessel described herein can also be affected by the location of the pivot axes, such as axes 230,232 shown in FIG. 3. The relative lengths of the portions of the forward hull section ahead of and astern of the pivot axis 232 and the relative lengths of the aft hull section ahead of and astern of pivot axis 230 may be varied to change the amount of weather helm available. For example, to increase weather helm, the length of the portion of the forward hull section ahead of axis 232 is increased relative to the length of that portion of the forward hull section aft of axis 232. In a similar manner, for increased weather helm the length of the aft hull section ahead of pivot axis 230 is increased relative to the length of the aft hull section behind the pivot axis 230 to further increase the amount of weather helm. Of course the opposite is true. By increasing the relative length of the aft portions of the forward and aft hull sections the amount of weather helm is decreased. As is well known, a weather helm for a sailing vessel is desired for safety, whereas less weather helm is desired for increased speed.

FIGS. 13 and 14 illustrate a modified version of the bendable hull arrangement previously described. In the embodiment of FIGS. 13 and 14 each hull, instead of being formed of two separate pivotally connected sections, is formed of a single unitary but flexible hull section. Thus, each hull 300,302, as illustrated in FIG. 13, can be bent in a smooth continuous curve to accomplish all of the same desired results as are accomplished by the above-described pivotally interconnected hull sections. In the arrangement of FIGS. 13 and 14, the flexible and bendable hulls are connected to a rigid deck structure 304 which may be identical to that previously described in connection with the earlier embodiment. As before, the deck structure holds the two hulls parallel to one another at all times. Again, as in the earlier embodiment, the deck structure is pivotally connected at points 306,308 to aft portions of the hulls and is pivotally and slidably connected at points 310,312 to forward areas of the hulls. The driving cross member 64, just as in the earlier described embodiment, is itself pivotally connected to intermediate points (preferably at the centers of the flexible hull portions) 316,318 on the port and starboard hulls so that when the cross member 64 is transversely shifted by the control rod 100 the hulls will bend in unison in one direction or the other, always remaining substantially parallel to each other and basically following congruent curves. The flexible hulls bend about substantially vertical axes, parallel to the vessel yaw axis.

As shown in FIG. 14, each integral unitary hulls is made flexible by employing a longitudinally extending spine 320 extending through the center of the length of at least an intermediate portion of the hull between pivot points 306 and 310 for the one hull and between pivot points 308 and 312 for the other hull. It will be readily understood that such a spine may extend for substantially the full length of the hull instead of just through such intermediate portion. The spine has vertical extent that is nearly the full vertical extent of each hull and is embedded in, bonded to, or otherwise fixed to a buoyant and flexible hull portion, indicated at 322. Buoyant hull portion 322 may be formed of a suitable bendable cellular floating plastic or the like, or may comprise a thin, flexible shell filled with tightly packed buoyant particles or foam pieces. For example, the spine may be molded into, and thus bonded to, a molded cellular foam buoyant hull portion 322. Each spine 320 thus is firmly secured to the buoyant portion 32 of each hull and fixedly carries a fitting, such as fitting 324, at an upper end of the spine for receiving pivotal or pivotal and sliding connections typically illustrated at 326 in FIG. 14. The spine 320 stiffens the buoyant hull section 322 and, being resilient, allows a limited amount (not more than about 30°) of bending required for steering the vessel. Because of its resiliency and tendency to return to its normal unstressed, straight condition the spine also exerts a force on the bent hulls, that tends to return the hulls to straight condition. The spine is preferably made of a strong but lightweight and resilient material and may be formed of materials such as aluminum, steel (having suitable cutout portions for decreasing weight), flexible, resilient plastic, or even laminated wood.

In the configuration of the flexible hulls of FIGS. 13, 14, less transverse motion of the cross member 64 is required for a given amount of relative angulation of forward and aft portions of each hull, as compared with the amount of cross member motion required in the pivotal interconnection of hull sections shown in the embodiment of FIGS. 1–12. This allows improved geometry of the steering mechanism, including greater leverage, or shorter links, or less required motions of parts.

In the arrangement of FIGS. 13 and 14 only that portion of the hulls between the deck connection points, such as the intermediate hull portions between points 306 and 310 for the port hole and between points 308 and 312 for the starboard hull, will bend. Thus a hull construction that allows for bending need be carried out only for such an intermediate portion, whereas portions of the hull ahead of the deck pivot points and aft of the deck pivot points may have other nonbending constructions.

The terms bend, bendable or the like, as used herein in connection with the vessel hulls, are meant to describe either or both of hull configurations wherein (a) two separate forward and aft hull portions are pivotally connected to each other and (b) a single integral and flexible intermediate portion that can be driven into a continuous longitudinally curved configuration and (c) a single flexible hull, continuous from bow to stern, that can be driven to a longitudinally curved configuration.

The foregoing detailed description is to be clearly understood as given by way of illustration and example only, the spirit and scope of this invention being limited solely by the appended claims.

What is claimed is:

1. A sailing vessel comprising:

first and second hulls each having a forward hull section with an aft end and an aft hull section with a forward end, said forward and aft ends of said hulls being positioned in mutual proximity and nominal alignment with each other, means for pivotally interconnecting the forward and aft sections of each hull to allow the sections of each hull to move through a plurality of positions in which the forward section extends longitudinally at different angles with respect to the aft section, deck means supported on said hulls for holding the hulls in mutually laterally spaced positions, said deck means being connected to one of the forward and aft sections of said hulls at points that slide longitudinally relative to the deck means as said one hull moves through said positions; and control means mounted on said deck means for causing said hulls to move through at least some of said positions.

2. A sailing vessel comprising:

first and second hulls each having a forward hull section with an aft end and an aft hull section with a forward end, said forward and aft ends of said hulls being positioned in mutual proximity and nominal alignment with each other, means for pivotally interconnecting the forward and aft sections of each hull to allow the sections of each hull to move through a plurality of positions in which the forward section extends longitudinally at different angles with respect to the aft section, deck means supported on said hulls for holding the hulls in mutually laterally spaced positions, and control means mounted on said deck means for causing said hulls to move through at least some of said positions, said deck means being pivotally connected to each said hull section about mutually parallel, generally vertical axes, and the pivotal connection between said deck means and a pair of corresponding hulls on either side of the vessel being configured and arranged for a limited amount of relative longitudinal sliding motion between such hull sections and the deck.

3. A sailing vessel comprising:

first and second hulls each having a forward hull section with an aft end and an aft hull section with a forward end, said forward and aft ends of said hulls being positioned in mutual proximity and nominal alignment with each other, means for pivotally interconnecting the forward and aft sections of each hull to allow the sections of each hull to move through a plurality of positions in which the forward section extends longitudinally at different angles with respect to the aft section, deck means pivotally and longitudinally slidably supported on said hulls for holding the hulls in mutually laterally spaced positions, and control means mounted on said deck means for causing said hulls to move through at least some of said positions, said means for pivotally interconnecting comprising a generally vertical pivot shaft extending through adjoining portions of the sections of each hull.

4. A sailing vessel comprising:

first and second hulls each having a forward hull section with an aft end and an aft hull section with a forward end, said forward and aft ends of said hulls being positioned in mutual proximity and nominal alignment with each other, means for pivotally interconnecting the forward and aft sections of each hull to allow the sections of each hull to move through a plurality of positions in which the forward section extends longitudinally at different angles with respect to the aft section, deck means pivotally and longitudinally slidably supported on said hulls for holding the hulls in mutually laterally spaced positions, and control means mounted on said deck means for causing said hulls to move through at least some of said positions, said means for pivotally interconnecting comprising a pivot arm fixed to and extending beyond one of said proximate ends of the sections of one of said hulls and a pivot shaft extending through said arm and through the adjoining end of the other of said mutually proximate ends of the sections of said one of said hulls.

5. A sailing vessel comprising:

first and second hulls each having a forward hull section with an aft end and an aft hull section with a forward end, said forward and aft ends of said hulls being positioned in mutual proximity and nominal alignment with each other, means for pivotally interconnecting the forward and aft sections of each hull to allow the sections of each hull to move through a plurality of positions in which the forward section extends longitudinally at different angles with respect to the aft section, deck means pivotally and longitudinally slidably supported on said hulls for holding the hulls in mutually laterally spaced positions, and control means mounted on said deck means for causing said hulls to move through at least some of said positions, said means for pivotally interconnecting comprising upper and lower pivot arms fixed to the aft end of at least one of said forward hull sections and extending rearwardly therefrom, said arms straddling upper and lower portions of the forward end of an associated one of said aft hull sections, and a pivot shaft extending through said arms and through said forward end of the aft hull section.

6. The sailing vessel of claim 1 wherein said control means comprises a cross member having ends pivotally connected to the forward and aft sections of each hull adjacent the pivotal interconnection between the forward and aft sections of each hull, and means for transversely driving said cross member to pivot said forward and aft sections of said hull relative to one another.

7. A sailing vessel comprising:

first and second hulls each having a forward hull section with an aft end and an aft hull section with a forward end, said forward and aft ends of said hulls being positioned in mutual proximity and nominal alignment with each other, means for pivotally interconnecting the forward and aft sections of each hull to allow the sections of each hull to move through a plurality of positions in which the forward section extends longitudinally at different angles with respect to the aft section, deck means pivotally and longitudinally slidably supported on said hulls for holding the hulls in mutually laterally spaced positions, and control means mounted on said deck means for causing said hulls to move through at least some of said positions, said deck means comprising a rigid structure spanning said hulls, said structure being pivotally connected to one section of each of said hulls and being pivotally and longitudinally slidably connected to the other section of each of said hulls.

8. A dual hull vessel comprising:

first and second articulated hull sections each having forward and aft sections pivotally interconnected about an axis substantially parallel to the yaw axis of the vessel to allow the sections of each hull to move from a position of mutual longitudinal fore and aft alignment to a plurality of positions wherein the forward section extends at an angle to the aft section that is pivotally connected thereto, means including pivotal and longitudinally slidable connections for interconnecting said hulls to maintain the forward sections parallel to each other and the aft sections parallel to each other, and control means for pivoting said forward sections relative to said aft sections.

9. A dual hull vessel comprising:

first and second articulated hull sections each having forward and aft sections pivotally interconnected about an axis substantially parallel to the yaw axis of the vessel to allow the sections of each hull to move from a position of mutual longitudinal fore and aft alignment to a plurality of positions wherein the forward section extends at an angle to the aft section that is pivotally connected thereto, means for interconnecting said hulls to maintain the forward sections parallel to each other and the aft sections parallel to each other, and control means for pivoting said forward sections relative to said aft sections, said means for interconnecting said hulls comprising a deck having a first pair of pivotal connections to respective ones of said forward hull sections, and having a second pair of pivotal connections to respective ones of said aft hull sections, the connections of one of said pairs of connections including means for longitudinally slidably connecting the deck to the associated hull sections for movement longitudinally of said hull sections.

10. A dual hull vessel comprising:

first and second articulated hull sections each having forward and aft sections pivotally interconnected about an axis substantially parallel to the yaw axis of the vessel to allow the sections of each hull to move from a position of mutual longitudinal fore and aft alignment to a plurality of positions wherein the forward section extends at an angle to the aft section that is pivotally connected thereto, means for interconnecting said hulls to maintain the forward sections parallel to each other and the aft sections parallel to each other, and control means for pivoting said forward sections relative to said aft sections, said means for interconnecting said hulls including a deck, a pair of pivotal connections between a forward portion of the deck and said forward hull sections, and a second pair of pivotal connections between an aft portion of said deck and said aft hull sections, one of said pairs of pivotal connections including longitudinally slidable connecting means for longitudinally slidably connecting the hull sections to said deck.

11. A sailing vessel comprising:

a pair of mutually laterally spaced hulls, each articulated about an axis that is nominally substantially vertical, a deck pivotally and longitudinally slidably secured to both hulls at points spaced from said axes of articulation, and control means mounted on the deck for bending each said hull about its axis of articulation.

12. The vessel of claim 11 wherein each said hull comprises a forward section having an aft end and an aft section having a forward end positioned adjacent to said aft end and pivotally connected thereto.

13. The vessel of claim 12 wherein said deck is pivotally and slidably connected to a section of each of said hulls.

14. The vessel of claim 12 wherein said deck is pivotally and slidably connected to one of said sections of a first one of said hulls and is pivotally and slidably connected to one of said sections of a second one of said hulls.

15. The vessel of claim 14 wherein said deck is pivotally connected to the other of said sections of said first hull and is pivotally connected to the other of said sections of said second hull.

16. The sailing vessel of claim 11 including a first pair of pivotal connecting means for pivotally connecting the deck to said hulls forward of said axes of articulation and a second pair of connecting means for pivotally connecting the deck to said hulls aft of said axes of articulation, the connecting means of one of said pairs including means for slidably connecting the deck to said hulls.

17. The sailing vessel of claim 16 wherein said control means comprises a cross member mounted to the deck for transverse motion relative to the deck and movably connected to said hulls adjacent said axes of articulation.

18. The sailing vessel of claim 11 including a longitudinal strut fixed to said deck and extending forwardly thereof, said strut including means for securing a head stay.

19. The sailing vessel of claim 18 wherein said control means comprises a control rod pivoted to said strut at one end thereof and slidably and guidably connected to said deck at the other end thereof, a cross member pivotally and slidably connected to said control rod, said cross member extending transversely between said hulls and having opposite ends pivotally connected to said hulls adjacent said axes of articulation.

20. A sailing vessel comprising:

a pair of mutually laterally spaced hulls, each configured and arranged to bend about an axis that is nominally substantially vertical, means for interconnecting said hulls to maintain said hulls generally parallel to each other, said means for interconnecting being connected to points on at least one of said hulls that are pivotally and longitudinally slidably movable relative to one another as said one hull bends, and control means mounted on said means for interconnecting for bending each said hull about its axis.

21. A sailing vessel comprising:

a pair of mutually laterally spaced hulls, each configured and arranged to bend about an axis that is nominally substantially vertical, deck means pivotally and longitudinally slidably mounted to said hulls for interconnecting said hulls to maintain said hulls generally parallel to each other, and control means mounted on the deck means for bending each said hull about its axis, said control means comprising a cross member having first and second ends connected to respective ones of said hulls adjacent said axes, and means on said interconnecting means for transversely shifting said cross member relative to said interconnecting means.

22. A sailing vessel comprising:

a pair of mutually laterally spaced hulls, each configured and arranged to bend about an axis that is nominally substantially vertical, deck means pivotally and longitudinally slidably mounted to said hulls for interconnecting said hulls to maintain said hulls generally parallel to each other, and control means mounted on the deck means for bending each said hull about its axis, said deck means for interconnecting said hulls comprising a deck pivotally and slidably connected to one of said hulls on one side of a point amidships of said hulls, and pivotally connected to said one hull on the other side of said point, whereby when said hulls are bent, the hulls will pivot relative to said deck on one side of said axes and will both pivot and slide relative to said deck on the other side of said axes.

23. The vessel of claim 20 wherein each of said hulls has substantially the same depth below the water line at bow and stern portions as it does at hull portions between the bow and stern.

24. The vessel of claim 20 wherein each said hull has substantially symmetrical transverse cross section.

25. The vessel of claim 20 wherein each said hull has slightly outwardly concave sides.

26. A steerable vessel having yaw and roll axes, said vessel comprising:

a fixed structure having first, second, third and fourth connecting points positioned in a quadrilateral pattern in a plane perpendicular to said yaw axis, port and starboard forward hull sections, each having forward and aft ends, port and starboard aft hull sections, each having a forward and aft ends, a pair of forward connecting means for connecting said structure at respective ones of said first and second points to respective ones of said forward hull sections intermediate their ends, a pair of aft connecting means for connecting said structure at respective ones of said third and fourth connecting points to respective ones of said aft hull sections intermediate their ends, the connecting means of one of said forward and aft pairs comprising means for connecting the structure to the associated hull sections for pivotal motion of the hull sections relative to the structure about axes parallel to said yaw axis, the connecting means of the other of said pairs comprising means for connecting the structure to the associated hull sections for relative pivotal motion about axes parallel to said yaw axis and for slidable motion parallel to said roll axis, control means on said structure for pivoting said hull sections relative to said structure, and means for constraining the forward ends of the aft hull sections to move together with the aft ends of the forward hull sections.

27. The vessel of claim 26 wherein said means for constraining comprises means for pivotally interconnecting the forward and aft ends of the aft and forward hull sections on each side of the vessel.

28. The vessel of claim 26 wherein said means for constraining comprises a direct pivotal connection between forward and aft hull sections.

29. The vessel of claim 26 wherein said control means comprises a cross member extending between the sections of one pair of said port and starboard hull sections and pivoted to at least one of said forward and aft ends of the sections of said one pair on each side about an axis parallel to said yaw axis.

30. The vessel of claim 26 wherein said control means comprises a cross member pivoted at one end to both port hull sections and at the other end to both starboard hull sections.

31. The vessel of claim 26 wherein the relative position of said connecting means with respect to the longitudinal extent of said hull sections is chosen to effect a desired degree of weather helm.

32. The vessel of claim 26 wherein the forward connecting means are longitudinally positioned relative to the forward hull sections at a position aft of the longitudinal midpoint of the forward hull sections.

33. The vessel of claim 26 wherein said aft connecting means are positioned longitudinally of said aft hull section at a point aft of the longitudinal midpoint of said aft hull section.

34. A sailing vessel comprising:

a pair of mutually laterally spaced hulls, each having an intermediate portion configured and arranged to bend in a nominally horizontal plane, a deck movably secured to both hulls at longitudinally spaced points on said intermediate portion, and control means mounted on the deck for bending each said intermediate portion between said longitudinally spaced points.

35. The vessel of claim 34 wherein the intermediate portion of each said hull comprises a strong, resilient and bendable spine extending longitudinally between said spaced points, and flexible floating means secured to said spine.

36. The vessel of claim 34 wherein each said intermediate portion includes forward and aft sections pivotally connected to one another for articulation about an axis that is nominally substantially vertical.

37. The vessel of claim 35 wherein said deck is pivotally and slidably connected to corresponding first and second points on said intermediate portions.

38. The vessel of claim 37 wherein said deck is pivotally connected to third and fourth points on said first and second hulls spaced longitudinally from said first and second points.

39. The sailing vessel of claim 34 including a first pair of pivotal connecting means for pivotally connecting the deck to a forward area of said hulls and a second pair of connecting means for pivotally connecting the deck to an aft area of said hulls, the connecting means of one of said pairs including means for slidably connecting the deck to said hulls.

40. The sailing vessel of claim 39 wherein said control means comprises a cross member mounted to the deck for transverse motion relative to the deck and movably connected to the intermediate portions of said hulls.

41. The sailing vessel of claim 34 including a longitudinal strut fixed to said deck and extending forwardly thereof, said strut including means for securing a head stay.

42. The sailing vessel of claim 41 wherein said control means comprises a control rod pivoted to said strut at one end thereof and slidably and guidably connected to said deck at the other end thereof, a cross member pivotally and slidably connected to said control rod and having opposite ends pivotally connected to said intermediate portions of said hulls.

43. A sailing vessel comprising:

a pair of mutually laterally spaced flexible hulls configured and arranged to bend in a nominally substantially horizontal plane, a deck, means for pivotally connecting said deck to said hulls at first and second forward points on respective ones of said hulls and at third and fourth aft points on respective ones of said hulls, said means for connecting comprising means for enabling longitudinally sliding motion between said deck and hulls at least two of said points, and control means on said deck for bending said hulls to steer said vessel.

44. A sailing vessel comprising:

first and second hulls leach having a forward hull portion and an aft hull portion, said hulls being configured and arranged to allow the portions of each hull to move through a plurality of positions in which the forward portion extends in a different direction than the aft portion, deck means supported on said hulls for holding the hulls in mutually laterally spaced and mutually parallel positions, said deck means having a pair of pivotal and longitudinally sliding connection to said hulls, and control means mounted on said deck means for causing said hulls to move through at least some of said positions.

45. A sailing vessel comprising:

first and second hulls each having a forward hull portion and an aft hull portion, said hulls being configured and arranged to allow the portions of each hull to move through a plurality of positions in which the forward portion extends in a different direction than the aft portion, deck means supported on said hulls for holding the hulls in mutually laterally spaced and mutually parallel positions, and control means mounted on said deck means for causing said hulls to move through at least some of said positions, said deck means being pivotally connected to each said hull portion about mutually parallel, generally vertical axes, and the pivotal connection between said deck means and a pair of corresponding hulls on either side of the vessel being configured for a limited amount of relative longitudinal sliding motion between such hull and the deck means.

46. A sailing vessel comprising:

first and second hulls each having a forward hull portion and an aft hull portion, said hulls being configured and arranged to allow the portions of each hull to move through a plurality of positions in which the forward portion extends in a different direction than the aft portion, deck means pivotally and longitudinally slidably supported on said hulls for holding the hulls in mutually laterally spaced and mutually parallel positions, and control means mounted on said deck means for causing said hulls to move through at least some of said positions, each hull comprising separate fore and aft sections, and including means for pivotally interconnecting the sections of at least one of said hulls to each other, said pivotally interconnecting means comprising a pivot arm fixed to and extending beyond one end of a section of one of said hulls and a pivot shaft extending through said arm and through an end of the other section of said one hull.

47. A sailing vessel comprising:

first and second hulls each having a forward hull portion and an aft hull portion, said hulls being configured and arranged to allow the portions of each hull to move through a plurality of positions in which the forward portion extends in a different direction than the aft portion, deck means pivotally and longitudinally slidably supported on said hulls for holding the hulls in mutually laterally spaced and mutually parallel positions, and control means mounted on said deck means for causing said hulls to move through at least some of said positions, each said hull including a flexible continuous intermediate portion having a thin flexible plate forming a spine therein.

48. A vessel of claim 47 wherein each control means comprises a cross member connected to said intermediate portions, and means for transversely driving said cross member to flexibly bend said intermediate portions.

49. The vessel of claim 47 wherein at least one of said flexible intermediate portions comprises a strong, flexible spine extending longitudinally of such intermediate portion, and flexible flotation means secured to said spine.

* * * * *